United States Patent [19]

Sugawara

[11] Patent Number: 4,646,472

[45] Date of Patent: Mar. 3, 1987

[54] DOOR FITTING DEVICE CAPABLE OF ADJUSTING AXIS OF ROTATION AND TORQUE

[75] Inventor: Tomonobu Sugawara, Tokyo, Japan

[73] Assignee: Takigen Manufacturing Co. Ltd., Tokyo, Japan

[21] Appl. No.: 856,016

[22] Filed: Apr. 25, 1986

[51] Int. Cl.[4] ..... E05F 1/10; E05D 7/08

[52] U.S. Cl. ..... 49/386; 16/75; 16/238; 49/388

[58] Field of Search ..... 49/386, 388; 160/206; 16/238, 308, 75, 79, 64

[56] References Cited

U.S. PATENT DOCUMENTS

| | | | |
|---|---|---|---|
| 2,878,531 | 3/1959 | Benham | 49/386 |
| 3,365,747 | 1/1968 | Barroero | 16/308 |
| 3,391,723 | 7/1968 | Kirby | 16/238 X |
| 3,507,074 | 4/1970 | Gallegos | 49/386 |
| 4,590,639 | 5/1986 | Fritsche et al. | 16/79 |

FOREIGN PATENT DOCUMENTS

| | | | |
|---|---|---|---|
| 1093533 | 11/1960 | Fed. Rep. of Germany | 16/308 |
| 201464 | 2/1966 | Sweden | 16/75 |

*Primary Examiner*—Philip C. Kannan

[57] ABSTRACT

A door fitting device capable of adjusting an axis of rotation and torque, which makes it possible to connect easily a torsion bar and a worm wheel and to engage the worm wheel with a worm. The door fitting device itself can be assembled easily and rapidly in parallel with fitting of the door to an upper and lower frame.

5 Claims, 24 Drawing Figures

DOOR FITTING DEVICE CAPABLE OF ADJUSTING AXIS OF ROTATION AND TORQUE

BACKGROUND OF THE INVENTION

This invention relates generally to a door fitting device for those doors which are rotatingly opened and closed with a perpendicular axis being the center. More particularly, the present invention relates to a door fitting device of the type in which a door closing rotary torque is provided by a torsion bar which undergoes elastic deformation.

In a door which rotates with a perpendicular axis being the center for the opening and closing operation, only one side of the door is supported by a fixed frame of the main body of a door by the door fitting device. Therefore, the weight of the door acts as an eccentric load upon the door fitting device and the door is likely to be inclined to its other unsupported side. When the other side of the door inclines downward beyond an allowable limit in the course of repeated use for an extended period of time, the door will not operate because the lower end of the unsupported side strikes a lower fixed frame. Therefore, the axis of rotation must be moved and adjusted in such a direction as to absorb the inclination of the door.

In order to use the door fitting device for a variety of doors having varying weights, the twist deformation quantity of a torsion bar under the door closed state, that is, an initial set quantity of the rotary torque, must be adjustable and changeable.

As an example of apparatuses which can relatively easily change and adjust the axis of rotation and the setting of the initial rotary torque, mention can be made of the door fitting device disclosed in Japanese Patent Laid-Open No. 191878/1983.

The door fitting device described above adjusts the setting of the initial rotary torque by the use of a worm wheel and a worm. Since a recess for storing the worm wheel is formed on the lower surface of a movable case, it is necessary to first store the worm wheel in the recess and then to fix a cover plate abutting on the lower surface of the worm wheel to the movable case in order to prevent the fall of the worm wheel.

At the stage of coupling and connecting the torsion bar to the worm wheel, it is by no means easy to fit a non-circular lower end portion of the torsion bar into a non-circular opening at the center of the worm wheel because the worm wheel is already assembled in the movable case and is disposed at the depth of the recess of the case.

SUMMARY OF THE INVENTION

It is therefore an object of the present invention to provide a door fitting device capable of adjusting the axis of rotation and torque, whose assembly can be made easily and rapidly in parallel with fitting of a door because a connecting operation between the torsion bar and the worm wheel, and an engagement operation between the worm wheel and the worm are easy.

DESCRIPTION OF THE PREFERRED EMBODIMENTS

Figure 1:
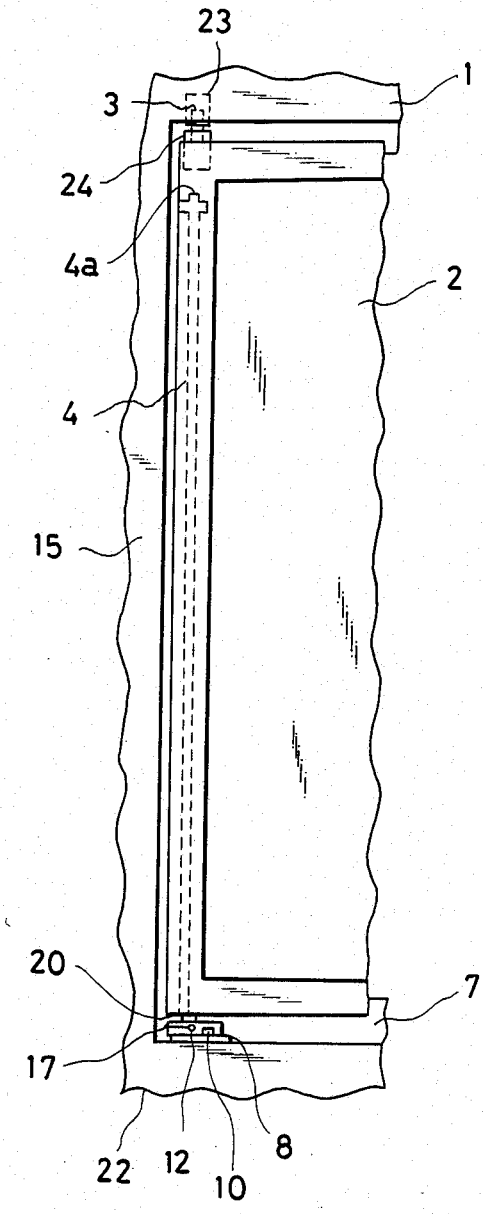
FIG. 1 is a front view of a door fitting portion of a cabinet using a door fitting device in accordance with one embodiment of the present invention.
Figure 2:
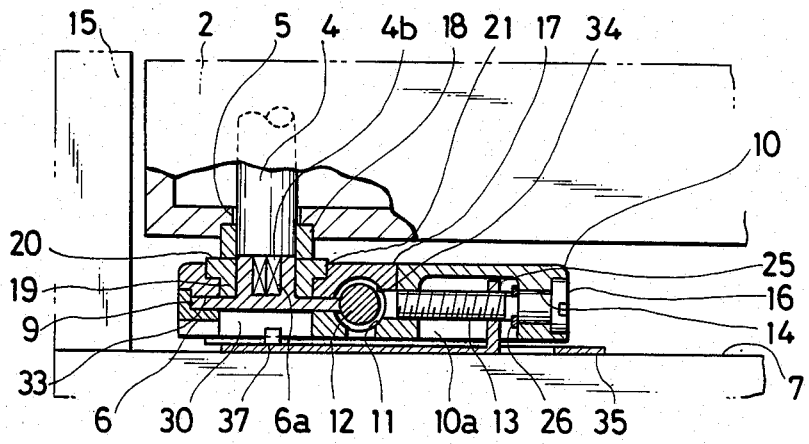
FIG. 2 is an enlarged longitudinal sectional view of the door fitting device.
Figure 3:
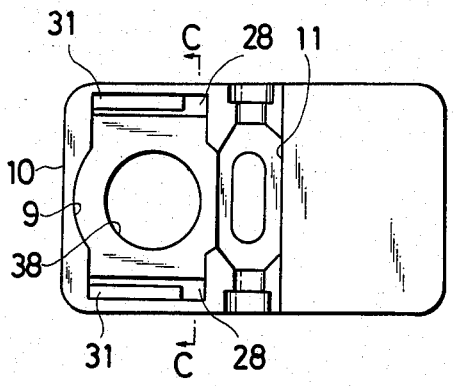
FIG. 3 is a plan view of a movable case of the door fitting device.
Figure 5:
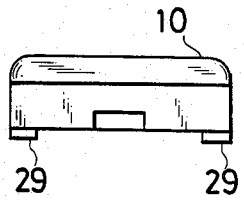
FIG. 5 is a left-hand side view of the movable case.
Figure 4:
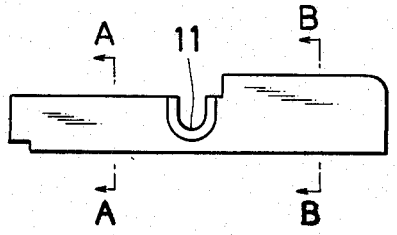
FIG. 4 is a front view of the movable case.
Figure 6:
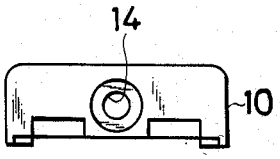
FIG. 6 is a right-hand side view of the movable case.
Figure 7:
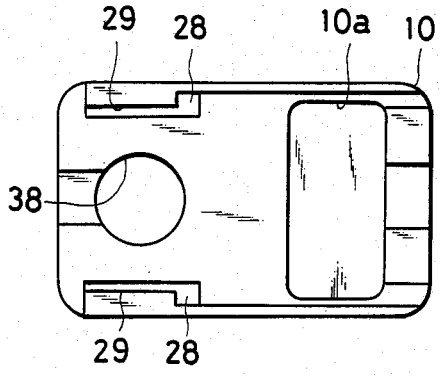
FIG. 7 is a bottom view of the movable case.
Figure 8:
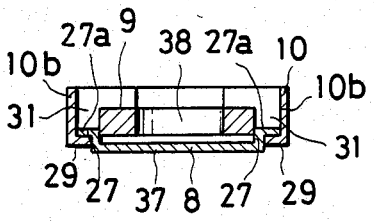
FIG. 8 is a sectional view taken along line A—A of FIG. 4.
Figure 9:
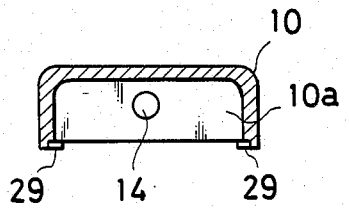
FIG. 9 is a sectional view taken along line B—B of FIG. 4.
Figure 10:
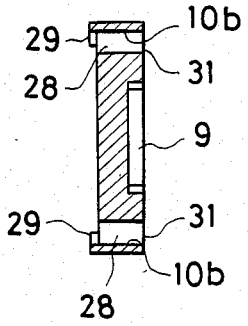
FIG. 10 is a sectional view taken along line C—C of FIG. 3.
Figure 11:
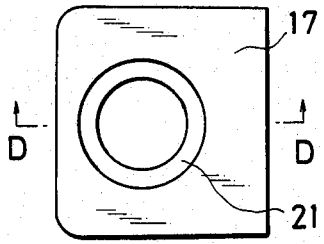
FIG. 11 is a plan view of a lid of the door fitting device.
Figure 12:
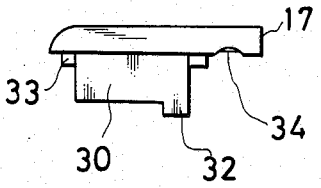
FIG. 12 is a front view of the lid.
Figure 13:
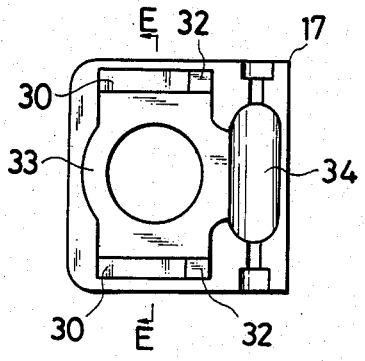
FIG. 13 is a bottom view of the lid.
Figure 14:
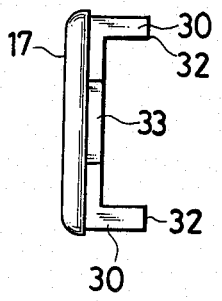
FIG. 14 is a right-hand side view of the lid.
Figure 15:
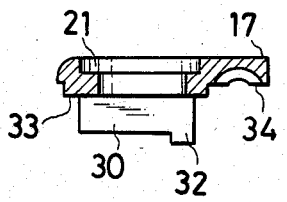
FIG. 15 is a sectional view taken along line D—D of FIG. 11.
Figure 16:
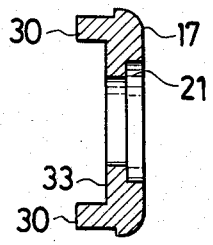
FIG. 16 is a sectional view taken along line E—E of FIG. 13.
Figure 17:
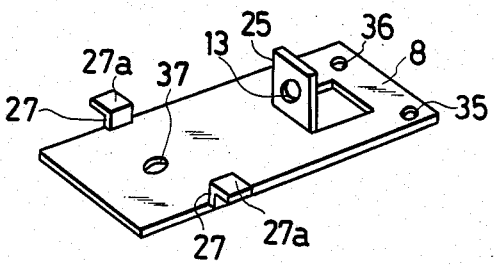
FIG. 17 is a perspective view of a substrate of the door fitting device.
Figure 18:
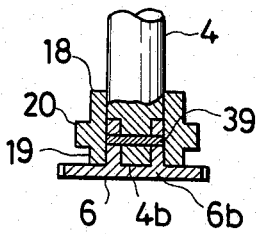
FIG. 18 is an enlarged sectional view of the connecting portion between a worm wheel and a torsion bar in the door fitting device in accordance with another embodiment of the present invention.

Hereinafter, some preferred embodiments of the invention will be described with reference to the accompanying drawings.

The door fitting device in accordance with the present invention comprises a vertical pivot 3 which rotatably supports the upper end portion of a door 2 relative to an upper horizontal frame 1; a torsion bar 4 which is disposed inside the door 2 on the lower extension of the vertical pivot 3 and has its upper end portion **4*a* fixed to the door 2; a worm wheel 6 which is unrotatably disposed on a lower end portion 4*b* of the torsion bar 4 that projects from a lower end opening 5 of the door 2; a substrate 8 which is fixed to a lower horizontal frame 7; a movable case 10 which is disposed in such a manner as to be capable of moving horizontally along the upper surface of the substrate 8 and is equipped on its upper surface with a recess 9 for storing the worm wheel 6; a worm 12 which is rotatably stored in a receiving groove 11 on the upper surface of the movable case 10 and engages with the worm wheel 6; an adjustment screw 16 which is inserted into a horizontal screw hole 13 of the substrate 8 and a horizontal through-hole 14 of the movable case 10, and moves back and forth the movable case 10 relative to a side portion vertical frame 15 by means of its normal and reverse rotation; a lid 17 which is fitted to the torsion bar 4, abuts on the upper surface of the movable case 10 and prevents the float of the worm wheel 6 and the worm 12; and a shaft cylinder 20 which is coaxially fitted to the torsion bar 4, whose upper end cylinder portion 18 is fitted into the opening 5 of the door 2 and whose lower end cylinder portion 19 is fitted to a ring-like step portion 21 on the upper surface of the lid 17**.

Before the door 2 is fitted to a cabinet main body 22 by use of the door fitting device of the present invention, the substrate 8 and the movable case 10 are assembled, and the adjustment screw 16 inserted in the horizontal through-hole 14 of the movable case 10 is further threaded into the horizontal screw hole 13 of the substrate 8. Next, the substrate 8 is fixed to a predetermined position of the lower horizontal frame 7 of the cabinet main body 22, that is, the position facing the bearing socket 23 disposed on the lower surface of the upper horizontal frame 1. The worm wheel 6 and the worm 12 are stored in the recess 9 of the movable case 10 and in the receiving groove 11, respectively.

The torsion bar 4 is in advance arranged inside the door 2, and its upper end portion **4*a* is fixed to the door 2 by key coupling, pin coupling or other suitable means. The vertical pivot 3 is fixedly secured to the upper end portion of the door 2**.

The shaft cylinder 20 and the lid 17 are fitted to the portion of the torsion bar that projects from the lower end surface of the door 2, and the upper end cylinder portion 18 of the shaft cylinder 20 is fitted into the lower end opening 5 of the door 2. On the other hand, the lower end cylinder portion 19 of the shaft cylinder 20 is fitted into the ring-like step portion 21 of the lid 17, and the door 2 is then carried between the upper and lower horizontal frames 1 and 7 while the lid 17 is being supported, so that the projecting end portion of the vertical pivot 3 can be fitted into the bearing socket 23.

Next, while the vertical pivot 3 and the bearing socket 23 are kept engaged with each other, the door 2 is lowered vertically so that the non-circular lower end portion **4*b* of the torsion bar 4 is fitted into the non-circular opening 6*a* of the worm wheel 6 and at the same time, the lid 17 is made to abut on the upper surface of the movable case 10 in order to prevent the float of the worm wheel 6 and the worm 12**.

The fitting state of the lid 17 and the movable case 10 is maintained by the weight of the door 2 that acts through the shaft cylinder 20. Finally, a spacer 24 is inserted between the upper end surface of the door 2 and the upper horizontal frame 1 lest the door 2 itself should float up due to vibrating impact at the time of opening and closing of the door.

The door 2 is opened and closed with the vertical pivot 3 and the shaft cylinder 20 being its axis of rotation. When the door 2 is inclined in the course of use for an extended period, the adjustment screw 16 is rotated in a predetermined direction so that the movable case 10 is moved horizontally relative to the substrate 8 and the axis is adjusted in such a manner as to absorb the inclination of the door 2.

When the door fitting device of the invention is used for a variety of doors having different weights, the rotary torque must be adjusted in accordance with the door weight. This can be conducted by rotating the worm 12 using a tool such as a screw driver, so as to adjust the initial twist quantity of the torsion bar 4 through the worm wheel 6. When the flexibility of the torsion bar 4 drops and the intended rotary torque can not be obtained, the rotary torque can be increased by similarly rotating the worm 12.

In the embodiment shown in the drawings, a projection plate 25 to be inserted into a lower surface hollow portion **10*a* of the movable case 10 is formed on the upper surface at one end portion of the substrate 8, and the horizontal screw hole 13 is formed on this projection plate 25. An E-ring 26 which abuts on the inner surface of the hollow portion 10*a* is provided at the neck of the adjustment screw 16, and prevents the adjustment screw 16 from escaping from the horizontal through-hole 14**.

A pair of projection plates 27, 27 are disposed at the other end portion of the upper surface of the substrate 8 at right angles relative to the projection plate 25 described above. The upper end bent portions **27*a*, 27*a* of these plates 27, 27 are inserted into the movable case 10 from lower surface rectangular holes 28, 28 of the movable case 10, and engage with elongated projections 29, 29 of the inner walls 10*b*, 10*b* of the movable case 10, respectively. Therefore, the movable case 10 neither floats up nor oscillates transversely, but can move linearly in parallel with the substrate 8**.

A pair of elongated wall portions 30, 30 are projectingly formed on the lower surface of the lid 17 and are fitted to upper surface elongated grooves 31, 31 which are formed in the proximity of the rectangular holes 28, 28 of the movable case 10, thereby preventing the rotation of the lid 17 relative to the movable case 10. When the lid 17 comes into close contact with the movable case 10, the end projection 32 of the elongated wall 30 closes the rectangular hole 28 and prevents the escape of the upper end bent portion of the projection plate 27.

A projection 33 and a receiving groove 34 are formed on the lower surface of the lid 17 in such a manner as to correspond to the recess 9 and the receiving groove 11 of the movable case 10, and accept part of the worm wheel 6 and worm 12. The shaft cylinder 20 is molded from a plastic material so that the door rotation is made smooth. When the movable case 10 is suitably moved by means of rotation of the adjustment screw 16, a pair of fixing holes 35, 36 of the substrate 8 are exposed outside the movable case 10, while another fixing hole 37 appears inside the center opening 38 of the recess 9 of the movable case 10. For this reason, the substrate 8 and the movable case 10 can be assembled beforehand in this embodiment.

In this embodiment, the lower end portion **4*b* of the torsion bar 4 has a non-circular cross-section and is fitted into the non-circular opening 6*a* of the worm wheel 6, so that the worm wheel 6 and the torsion bar 4 are connected to each other unrotatably. However, they can be connected unrotatably by first fitting the non-circular lower end portion 4*b* of the torsion bar 4 into the round opening 6*b* of the worm wheel 6, and then implanting transverse pins 39** to both of them. It is also possible to integrally mold or integrally couple the worm wheel and the torsion bar from the beginning.

Figure 19:
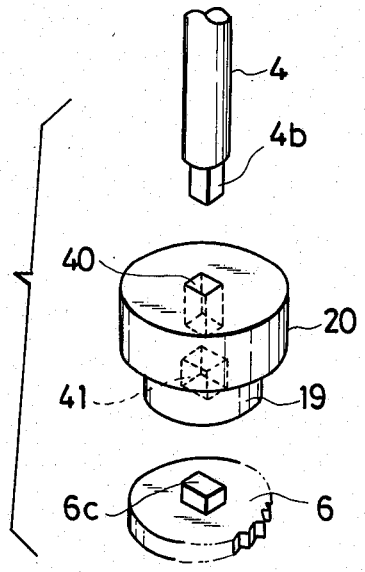
FIG. 19 is a perspective view of a torsion bar, a shaft cylinder and a worm wheel of another embodiment of the present invention.
Figure 20:
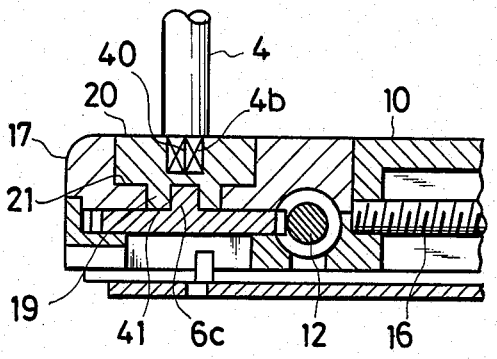
FIG. 20. is an enlarged longitudinal sectional view of a door fitting device in which the torsion bar, the shaft cylinder and the worm wheel of FIG. 19 are used.

In another embodiment shown in FIGS. 19 and 20, a rectangular hole 40 is formed on the upper surface of the shaft cylinder 20 which is fitted rotatably into the ring-like step portion 21 of the lid 17 of the movable case 10, and a rectangular hole 41 is formed on the lower surface of the lower end cylinder portion 19. The lower end portion 4*b* of the torsion bar 4 having a rectangular cross section is unrotatably fitted into this rectangular hole 40 and the projection 6*c* of the worm wheel 6 having a rectangular cross section is fitted into the rectangular hole 41 so that the torsion bar 4 and the worm wheel 6 are unrotatably connected to each other through the shaft cylinder 20. The rest of the construction are the same as the construction of the embodiment shown in FIGS. 1 through 17.

Figure 21:
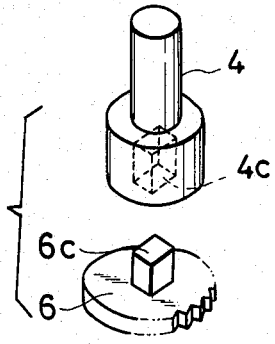
FIG. 21 is a perspective view of a torsion bar and a worm wheel of a further other embodiment of the present invention.
Figure 22:
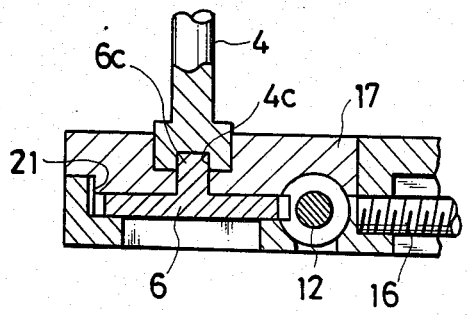
FIG. 22 is an enlarged longitudinal sectional view of a door fitting device in which the torsion bar and the worm wheel of FIG. 21 are used.
Figure 23:
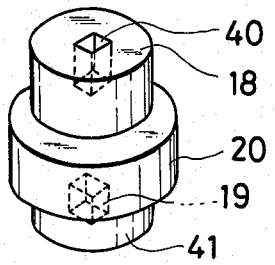
FIG. 23 is a perspective view of a shaft cylinder of other embodiment of the present invention.

In still another embodiment of the invention shown in FIGS. 21 and 22, a rectangular hole 4*c* opening on its lower surface is formed at the lower end of the torsion bar 4, and the projection 6*c* of the worm wheel 6 having a rectangular cross section is fitted into this hole 4*c*. Still another embodiment of the invention shown in FIG. 23 is equipped with an upper end cylinder portion 18 which is fitted into the lower end opening 5 of the door 2, in comparison with the shaft cylinder 20 of the embodiment shown in FIG. 19.

Figure 24:
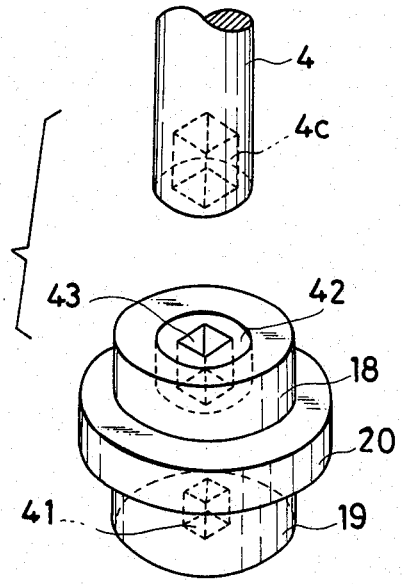
FIG. 24 is a perspective view of a torsion bar and a shaft cylinder of a further embodiment of the present invention.

In still another embodiment of the invention shown in FIG. 24, a round recess 42 is formed so as to open on the upper surface of the upper end cylinder portion 18 of the shaft cylinder 20, and a projection 43 having a rectangular cross section is formed at the center of the round recess 42. A rectangular hole 4*c* opening on its lower surface is formed at the lower end portion of the torsion bar 4 which has a round cross section and is to be fitted into the round recess 42. When the rectangular hole 4*c* and the projection 43 fit with each other, the torsion bar 4 and the shaft cylinder 20 are connected in such a manner as not to be capable of relatively rotating with each other. A rectangular hole 41 into which the projection 6*c* of the worm wheel 6 having the rectangular cross section is fitted is formed at the lower end cylinder portion 19 of the shaft cylinder 20.

As described above, in the door fitting device of the present invention, the substrate 8 is fixedly fitted to the lower horizontal frame 7, and the recess 9 for storing the worm wheel 6 and the receiving groove 11 for the worm 12 are formed on the upper surface of the movable case 10 which is connected to the substrate 8 by the adjustment screw 16. The lid 17 inserted into the torsion bar 4 is made to abut on the upper surface of the movable case 10 in order to prevent the float of the worm wheel 6 and the worm 12. Similarly, the upper end cylinder portion 18 of the shaft cylinder 20 fitted to the torsion bar 4 is inserted in the lower end opening 5 of the door 2 while the lower end cylinder portion 19 is fitted to the ring-like step portion 21 on the upper surface of the lid 17, so that the weight of the door 2 can be borne by the lid 17 through the shaft cylinder 20, and the lid 17 and the movable case 10 can be kept in the fit state.

The connecting operation of the torsion bar 4 and the worm wheel 6 and the engagement operation between the worm wheel 6 and the worm 12 can be made easily under the clearly visible state while the lid 17 is lifted up, and the assembly of the device itself that is to be effected simultaneously with fitting of the door can be made easily and rapidly.

What is claimed is:

1. A door fitting device capable of adjusting an axis of rotation and torque, which comprises:

a vertical pivot 3 supporting rotatably the upper end portion of a door 2 relative to an upper horizontal frame 1;

a torsion bar 4 disposed inside said door 2 on the lower extension of said vertical pivot 3, and fixedly secured at its upper end portion 4*a* to said door;

a worm wheel 6 disposed unrotatably to the lower end portion 4*b* of said torsion bar projecting from a lower end opening 5 of said door 2;

a substrate 8 fixedly secured to a lower horizontal frame 7;

a movable case 10 disposed movably in a horizontal direction along the upper surface of said substrate 8, and equipped on its upper surface with a recess 9 for storing said worm wheel 6;

a worm 12 stored rotatably in a receiving groove 11 on the upper surface of said movable case 10, and engaging with said worm wheel 6;

an adjustment screw 16 inserted into a horizontal screw hole 13 of said substrate 8 and into a horizontal through-hole 14 of said movable case 10, for moving back and forth said movable case 10 relative to a side vertical frame 15 by means of normal and reverse rotation thereof;

a lid 17 fitted to said torsion bar 4, said lid abutting on the upper surface of said movable case 10 and preventing the float of said worm wheel 6 and said worm 12; and a shaft cylinder 20 fitted coaxially to said torsion bar 4, and having the upper end cylinder portion 18 fitted into said opening 5 of said door 2 and the lower end cylinder portion 19 thereof fitted to a ring-like step portion 21 on the upper surface of said lid 17.

2. The door fitting device of claim 1, wherein said substrate 8 includes a projection plate 25 formed on an upper surface of the substrate 8, and contains said horizontal screw hole 13 and is inserted into a lower surface hollow portion 10*a* of said movable case 10.

3. The door fitting device of claim 1, wherein said substrate 8 includes a pair of projection plates 27,27 disposed on the upper surface of the substrate, said projection plates each being inserted into rectangular holes 28,28 of said movable case 10.

4. The door fitting device of claim 1, wherein said lid 17 includes a pair of elongated wall portions 30,30 formed on the lid lower surface and are fitted into elongated grooves 31,31 of said movable case 10.

5. The door fitting device of claim 1, wherein said lower end portion 4*b* of said torsion bar 4 has a non-circular cross-section which is fitted into a non-circular opening 6*a* in said worm wheel 6 so as to non-rotatably connect the torsion bar to the worm gear.

* * * * *